US005293663A

United States Patent [19]

McCullough

[11] Patent Number: 5,293,663

[45] Date of Patent: Mar. 15, 1994

[54] FLUID CLEANING SYSTEM

[75] Inventor: Timothy J. McCullough, Vermilion, Ohio

[73] Assignee: Food Industry Equipment International, Inc., Lorain, Ohio

[21] Appl. No.: 64,709

[22] Filed: May 19, 1993

Related U.S. Application Data

[63] Continuation-in-part of Ser. No. 777,694, Oct. 15, 1991, abandoned.

[51] Int. Cl.[5] ..... B08B 5/02

[52] U.S. Cl. ..... 15/318.1; 15/302

[58] Field of Search ..... 15/339, 316.1, 319, 15/318.1, 302

[56] References Cited

U.S. PATENT DOCUMENTS

| | | | |
|---|---|---|---|
| 2,814,176 | 11/1957 | Bowie | 57/56 |
| 3,233,997 | 2/1966 | Moreau | 65/184 |
| 3,571,840 | 3/1971 | Gleaton et al. | 15/312 |
| 4,048,689 | 9/1977 | Fullenkamp et al. | 15/3.17 |
| 4,141,103 | 2/1979 | Crise | 15/346 |
| 4,202,073 | 5/1980 | Hughes | 15/306 |
| 4,207,650 | 6/1980 | Crise | 15/404 |
| 4,253,903 | 3/1981 | McDonald | 156/389 |
| 4,510,784 | 4/1985 | Hsu | 72/201 |
| 4,807,321 | 2/1989 | Grasselli | 15/312 R |
| 4,965,909 | 10/1990 | McCullough | 17/21 |

*Primary Examiner*—Chris K. Moore
*Attorney, Agent, or Firm*—Michael Sand Co.

[57] ABSTRACT

A fluid cleaning system for removing meat particles from a rotating roll of a meat stripping machine with a minimum amount of pressurized fluid and water by sequentially opening and closing individual groups of fixed fluid nozzles located closely adjacent the roll. An air manifold extends longitudinally along the roll and is formed with groups of nozzles, each group being supplied by its own air supply channel. The air supply channels terminate in an annular air distribution chamber which is connected to a source of pressurized air. A disc, formed with at least one opening, is rotated within the chamber for sequentially opening at least one of the supply channels while maintaining the other supply channels closed from the pressurized air source. The roll and disc are driven by the same motor but at different speeds. Since only one group of nozzles is connected to the source of pressurized air at any one time, the supply of pressurized air is less than that required to supply all nozzles at the same time. The nozzle groups produce high velocity, momentary bursts of air longitudinally and circumferentially along and against the rotating roll to dislodge and remove the meat particles from the roll as the roll rotates past the nozzles while stripping skin and particles from a piece of meat. A water supply line also may be connected to each of the air supply channels through a ball check valve to supply a small quantity of water sequentially into the air supply channels for subsequent discharge with the pressurized air against the roll being cleaned.

21 Claims, 6 Drawing Sheets

FLUID CLEANING SYSTEM

This application is a continuation-in-part of my prior co-pending application Ser. No. 07/777,694, filed Oct. 15, 1991, and now abandoned.

BACKGROUND OF THE INVENTION

1. Technical Field

The invention relates to cleaning systems and, in particular, to a cleaning system for a meat processing machine. More particularly, the invention relates to a system which produces momentary bursts of pressurized fluid against and along a rotating tooth roll to dislodge and remove particles from the roll as the roll rotates past the nozzles while removing skin and other particles from meat.

2. Background Information

Various equipment in the meat processing industry use tooth rolls for removing skin and other particles from a piece of meat which is fed, either manually or automatically, past the rotating roll. One problem that is encountered with such tooth meat stripping rolls is that they quickly become clogged with skin, meat particles, fat and the like, reducing considerably their efficiency in a relatively short period of time. This requires stopping the machine and manually removing the collected particles from the roll teeth.

Various types of cleaning systems have been devised for removing such particles from the tooth rolls without interrupting the meat processing operation. One type of system is shown in U.S. Pat. No. 4,807,321. This system provides air nozzles which are moved axially along the rotating tooth roll so that pressurized air is discharged from the nozzles against the rotating roll to remove particles therefrom. Although this apparatus may provide some cleaning of the tooth roll, it requires a number of moving parts and requires pressure seals which are subject to leakage. It also requires a relatively large volume of pressurized air in relationship to the number of nozzles in order to provide a sufficient cleaning system.

Another type of cleaning system using pressurized air which is impinged against the work being cleaned is shown in U.S. Pat. No. 3,571,840, and is used in the textile industry. In this prior system, a plurality of nozzles are oscillated back and forth across the roll being cleaned. In order to reduce the volume of pressurized air, the system has either a sliding plate or a hollow internal rotating cylinder which selectively opens and closes the inlets to the nozzles so that only one or several of the nozzles are being supplied with the pressurized air at any one time. This reduces the amount of pressurized air required, and reduces the size of the air supply system and power to provide the same. However, with this textile cleaning system, the nozzles are oscillated back and forth requiring additional motive power. Furthermore, such a system requires a relatively large internally rotating drum or sliding plate which requires increased power to operate the mechanical mechanism, in addition to the extra power required to oscillate the nozzles across the rotating roll.

Although the use of only pressurized air impinged against the rotating roll of a meat skinning machine is satisfactory for moving most of the trapped meat particles, it has been found that the use of jets of pressurized water impinged against the roll has increased cleaning ability to dislodge and remove the meat particles trapped between the teeth of the rotating roll.

Although these water cleaning systems increase the cleaning efficiency on the roll in contrast to those systems using only streams of high pressure air, they require a considerable amount of water and equipment for pressurizing the water, which increases considerably the cost of operating the cleaning system. Such prior water cleaning systems require the initial supply of water to the cleaning mechanism, as well as additional equipment for collecting and removing the large amounts of spent water, for subsequent discharge into a sewage system, which increases the total cost of the system, or requires expensive recirculating and processing equipment for cleaning such large amounts of spent water for subsequent use, in a closed water cleaning system.

None of the known prior art cleaning machines provide for pressurized air which is impinged against the roll of a meat cleaning machine to be supplied with relatively small amounts of water which is mixed with the pressurized air just prior to it being discharged from the spray nozzle, whereby a mixture of pressurized air and water is discharged from the cleaning nozzles and impinged against the rotating roll to remove the meat particles therefrom.

Therefore, the need has existed for an improved cleaning system for meat processing machines in which the cleaning system is operable during the process to provide for continuous cleaning of the meat or skin removing roll, which does not interfere with the cleaning operation, which requires a minimum volume of pressurized fluid to clean the roll, and which requires a minimum number of moving parts and eliminates maintenance prone moving air seals.

SUMMARY OF THE INVENTION

Objectives of the invention include providing an improved fluid cleaning system for removing meat particles from a rotating roll of a meat stripping machine with a minimum amount of pressurized fluid by sequentially opening and closing individual groups of fixed fluid nozzles located closely adjacent the roll.

A still further objective is to provide such an improved cleaning system using only a simple rotating disc as the moving component for selectively directing pressurized fluid to groups of nozzles spaced in a fixed position axially along the rotating roll and beneath a meat delivery shelf in order to be sufficiently removed from the meat processing area to prevent interference therewith.

Another objective of the invention is to provide such a cleaning system which is able to utilize the drive motor of the meat stripping roll and be synchronized therewith, to ensure that all areas of the rotating roll are impinged with the pressurized fluid which is delivered in high velocity momentary bursts on the roll in such a sequence and pattern to ensure that all areas of the roll are sufficiently clean as it moves past the fixed nozzles.

A further objective of the invention is to provide such an improved cleaning system which can be incorporated into existing meat processing machines or formed as a part of new machines by the use of a relatively small number of sturdy, durable and rugged components which are unaffected by the harsh environment which the skinning machine experiences, yet which can be cleaned and maintained in a sanitary condition as is required for meat processing equipment.

Still another objective of the invention is to provide such a cleaning system in which relatively small amounts of water are injected into to the supply of pressurized air for subsequent mixing with the pressurized air, just prior to being discharged from the cleaning nozzles so that a water and air mixture is impinged against the roll to provide an increased cleaning effect than that achieved by prior cleaning systems using only high pressurized air or large volumes of high pressurized water.

These objectives and advantages are obtained by the improved fluid cleaning system of the invention which is used for removing particles from a rotating roll of a meat processing machine, in which the system includes a manifold formed with a plurality of fluid discharge nozzles extending in a generally axial direction along the roll for directing streams of a pressurized fluid against the rotating roll; a plurality of fluid supply channels having inlet openings, each of the channels communicating with a selected group of nozzles of the manifold nozzles for selectively supplying pressurized fluid to each of the selected nozzle groups; fluid control means for sequentially opening and closing the fluid supply channels whereby only certain of the supply channels are open at the same time and are being supplied with fluid for subsequent discharge through their respective nozzle groups for discharge against the rotating roll, the control means including a rotating disc which sequentially opens and closes the fluid supply channels as it rotates past fluid inlet openings of the supply channels.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 2:
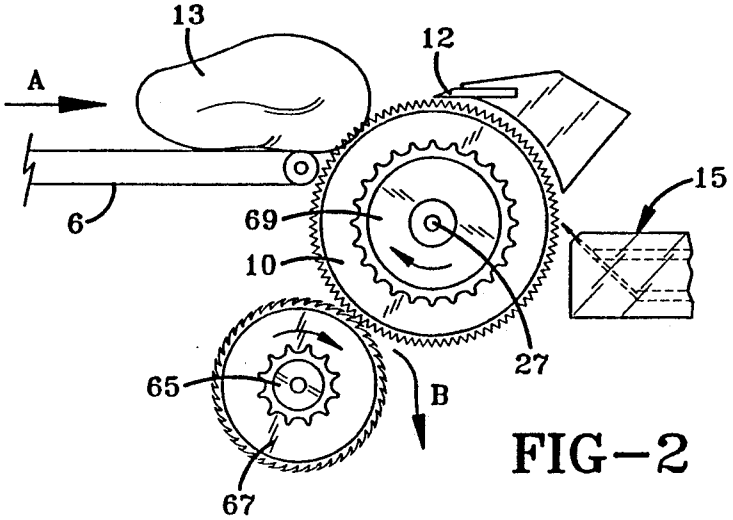
FIG. 2 is a diagrammatic side elevational view showing the cleaning system in combination with a tooth roll and a stripping roll.
Figure 1:
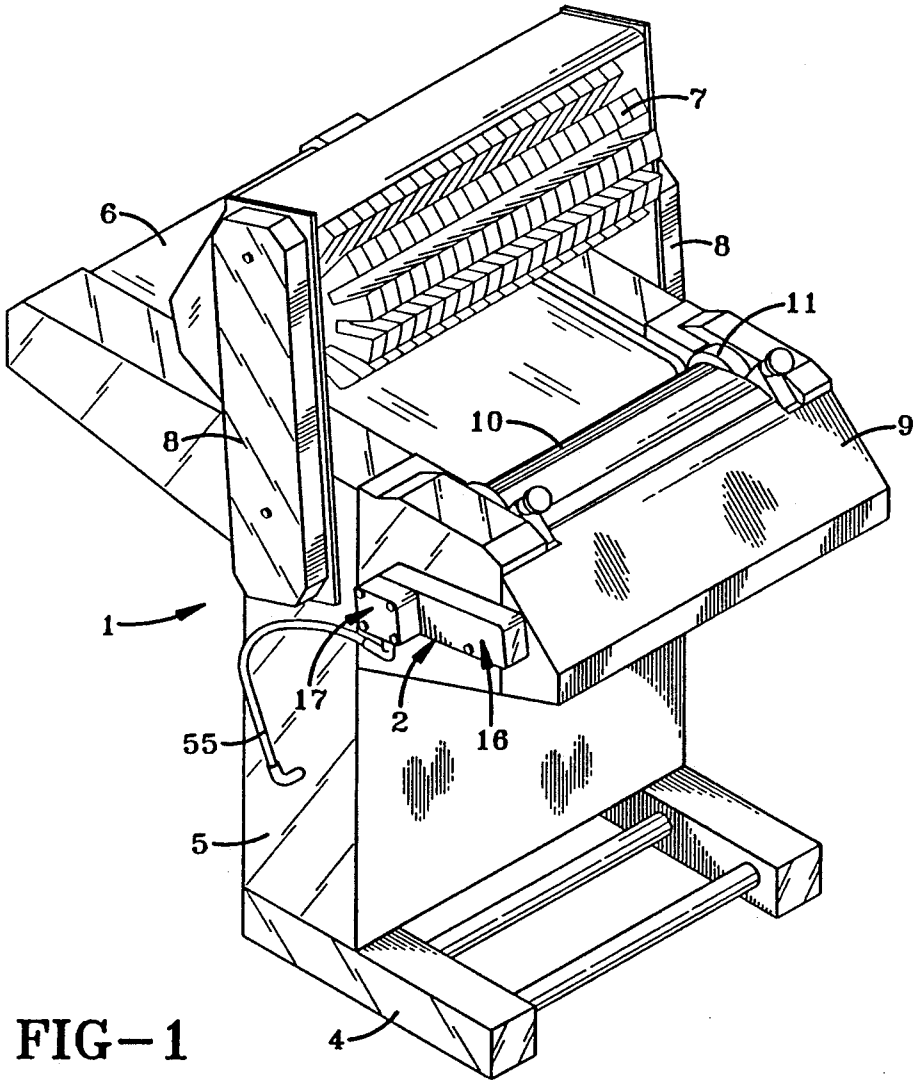
FIG. 1 is a perspective view of one type of meat processing equipment having the improved cleaning system incorporated therein.
Figure 4:
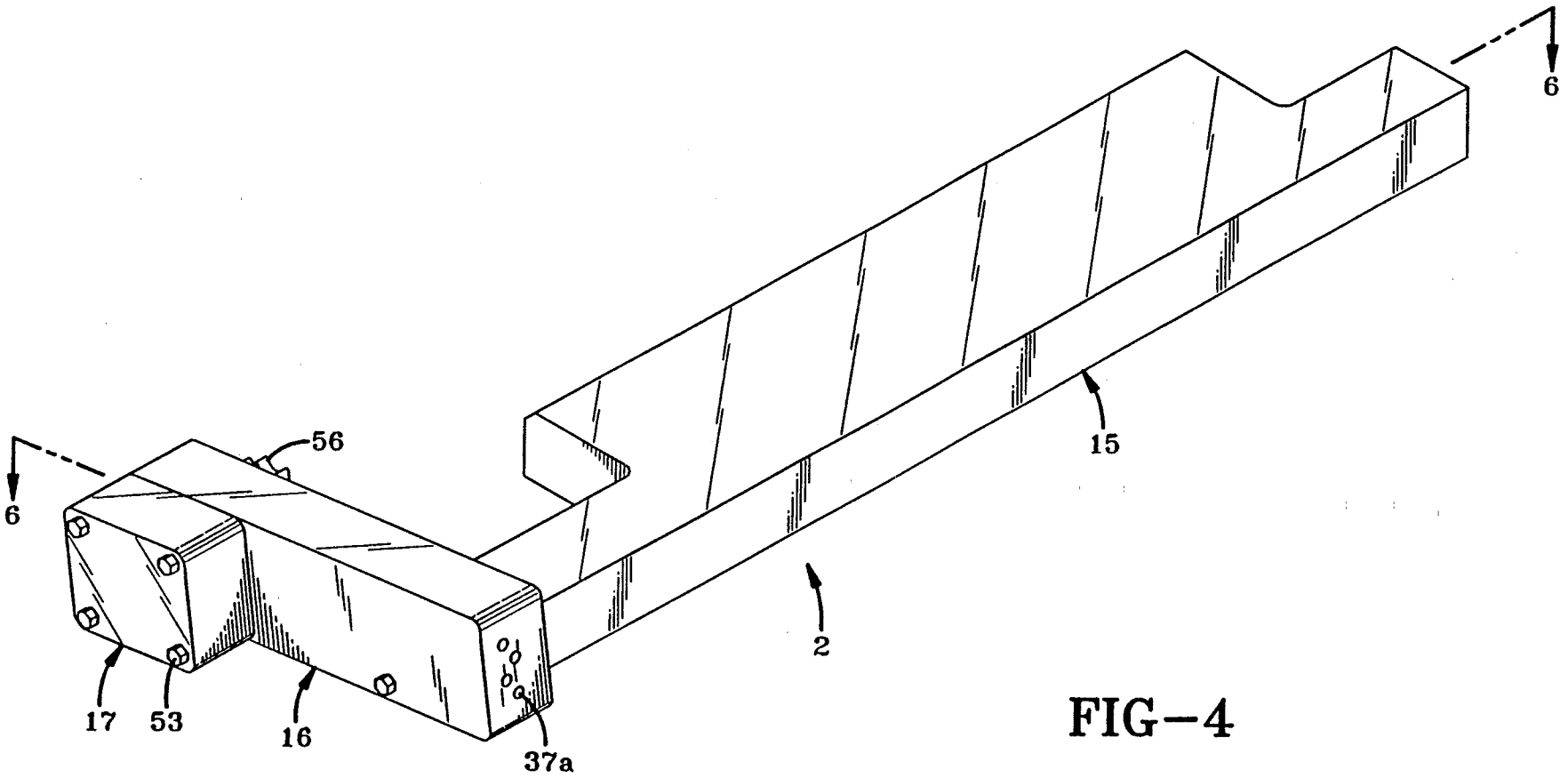
FIG. 4 is an enlarged perspective view of the fluid cleaning system removed from the cleaning machine of FIG. 1.
Figure 5:
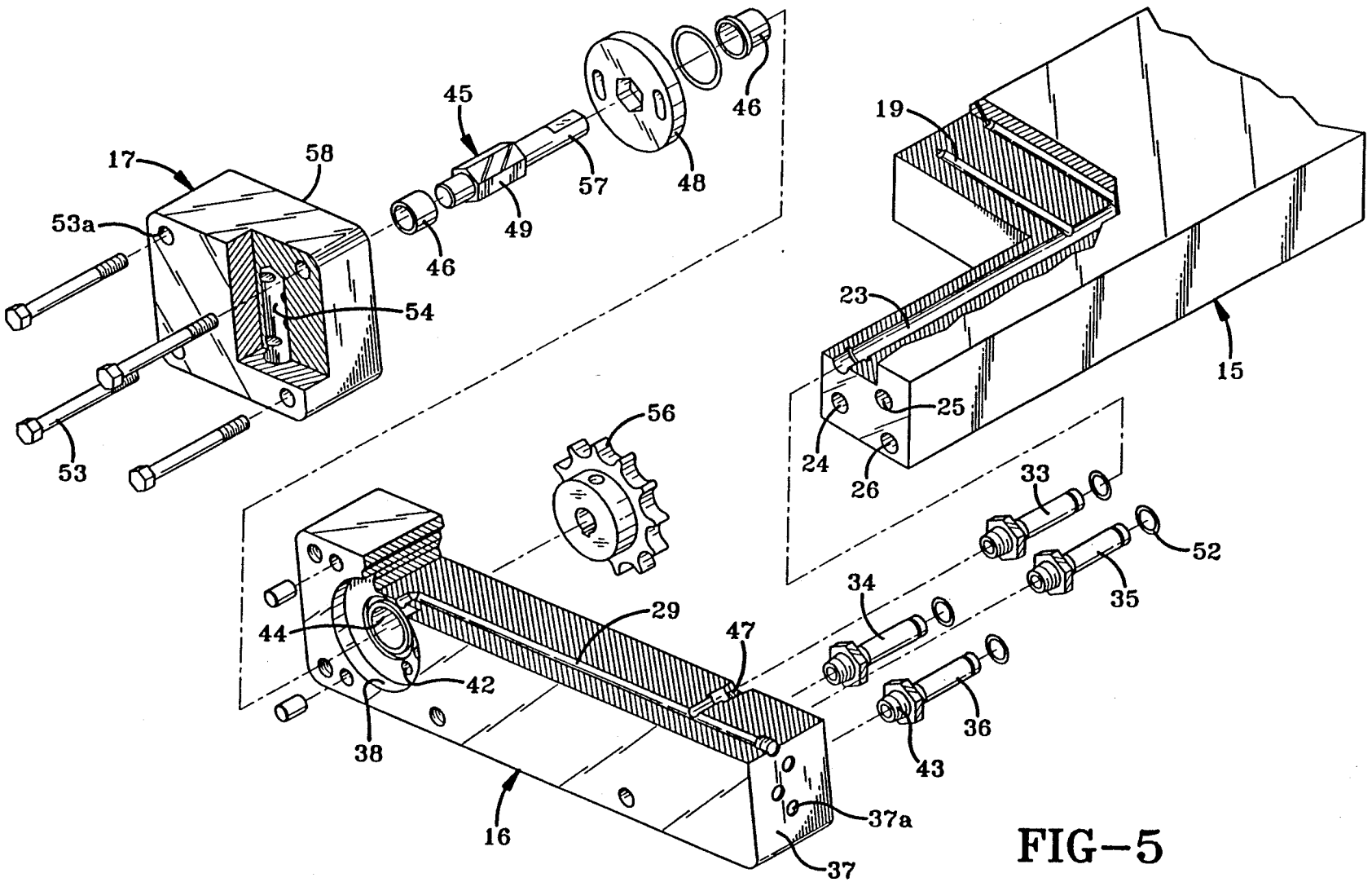
FIG. 5 is an exploded perspective view with portions broken away and in section, of the improved cleaning system of FIG. 4.

FIG. 1 shows one type of equipment indicated generally at 1, in which the improved fluid cleaning system, which is shown particularly in FIGS. 4 and 5 and indicated generally at 2, can be mounted. Machine 1 is a type of meat processing equipment well known in the art, consisting of a lower support base 4, an upstanding frame 5, and a conveyor 6. Conveyor 6 automatically brings a piece of meat 13 into the machine in the direction of arrow A, FIG. 2. A horizontally extending rotating feed roll 7 which is supported on a pair of spaced frame members 8 above conveyor 6, assist in moving meat 13 into contact with a skin removing tooth roll 10 and a knife blade 12. Roll 10 is rotatably mounted adjacent to discharge end of conveyor 6 by a pair of end bearings 11, and in combination with blade 12 removes the skin or performs other meat processing functions on a piece of meat 13 being moved along conveyor 6. An operator may be stationed adjacent to the discharge end or shelf 9 of machine 1 to manually remove the meat therefrom, or another conveyor can be located adjacent thereto for automatically removing the meat after it has passed over and beyond blade 12 and roll 10.

Another type of a meat processing machine with which the improved fluid cleaning system may be utilized, is shown in U.S. Pat. No. 4,965,909. The particular equipment shown particularly in FIGS. 1 and 2 and in the above mentioned patent are illustrations of two types of machines with which the improved fluid cleaning system may be utilized. However, it is readily understood that the invention need not be limited to these exact pieces of equipment.

Figure 6:
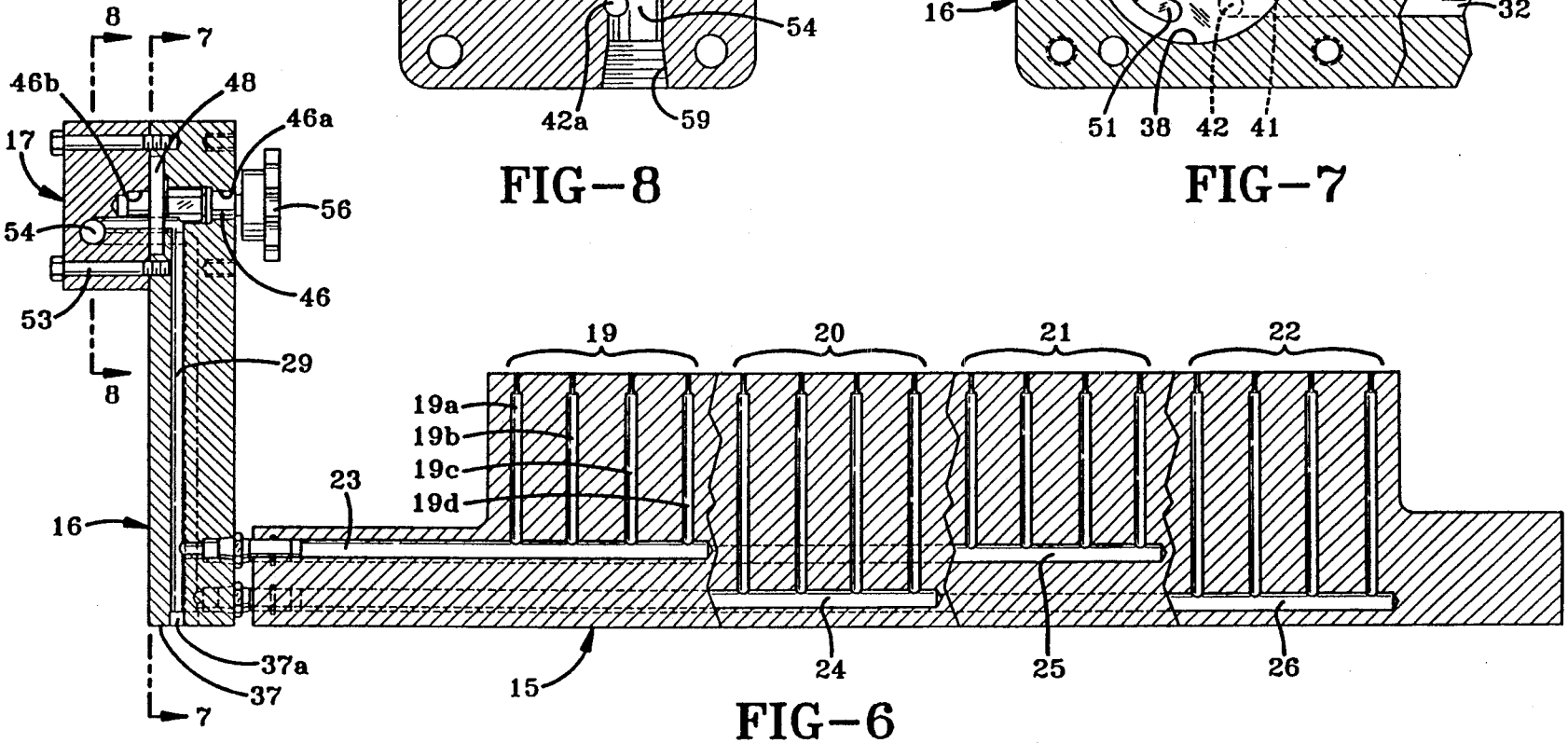
FIG. 6 is an enlarged fragmentary sectional view taken on line 6—6, FIG. 4.
Figure 9:
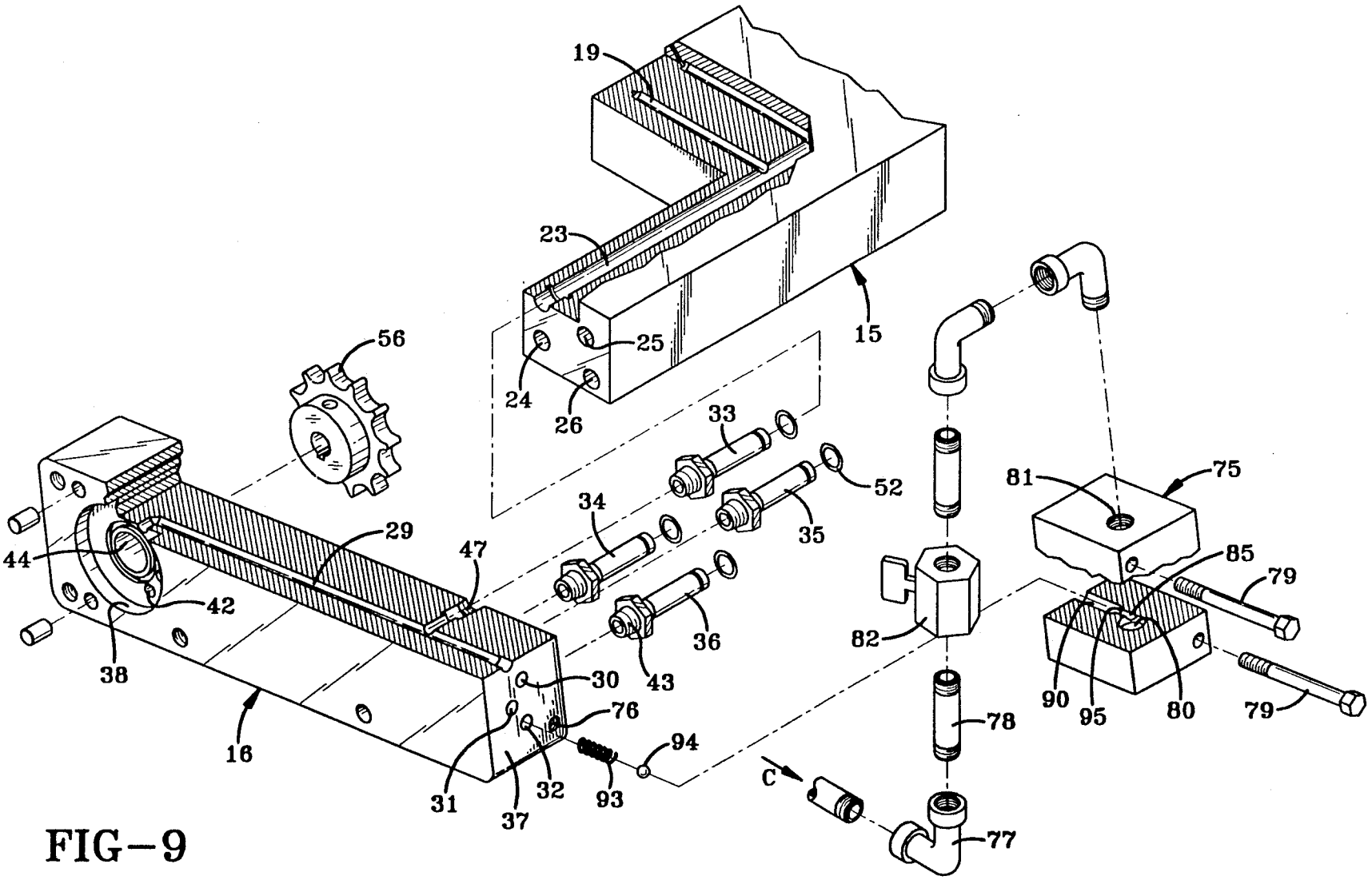
FIG. 9 is an exploded fragmentary perspective view of certain of the components of the improved cleaning system as shown in FIG. 5, in combination with a water supply chamber.

The improved fluid cleaning system is best illustrated in FIGS. 4, 5 and 6, and includes as its main components, an air manifold 15, an air supply block 16, and a manifold cap 17. Components 15-17 preferably are formed of aluminum castings so as to provide components of a lightweight, durable, rust free material which is easily maintained in a sanitized condition and is able to withstand the wet and greasy environment to which they are subjected during the processing of meat.

Air manifold 15 (FIG. 6) is formed with four groups of fluid discharge nozzles indicated at 19, 20, 21 and 22. Each group of nozzles is supplied by its own air supply channel 23, 24, 25 and 26 respectively, which preferably are formed by drilling into the aluminum block of material which forms air manifold 15. Air manifold 15 is mounted by various attachment means (not shown) beneath discharge shelf 9 of equipment 1, and extends in a horizontal longitudinal axial direction with respect to axis 27 of tooth roll 10.

Air supply block 16 (FIGS. 5-7) is formed with four air inlet lines, 29, 30, 31 and 32 which are connected to air supply channels 23, 24, 25 and 26 respectively, through quick-connect couplers 33, 34, 35 and 36, respectively. One end of each coupler has a threaded end 43 which is secured within a threaded opening 47 (FIG. 5) formed in supply block 16 for communication with the respective air inlet line. The opposite ends of the couplers have O-ring seals 52 to provide a slip-fit connection within the respective air supply channel of manifold 15. Air inlet lines 29–32 preferably are formed by drilling into block 1 from end face 37 thereof (FIG. 5), into which plugs 37*a* are pressed to seal the ends of the lines.

In further accordance with the invention, an annular air distribution chamber 38 is formed in one end of air supply block 16 (FIGS. 5 and 7) and has four outlet holes 39, 40, 41 and 42 formed therein which communicate with air inlet lines 29, 30, 31 and 32, respectively, of air supply block 16. Outlet holes 39–42 are spaced in an arcuate path within distribution chamber 38. Air supply block 16 is formed with a circular hole 44 extending through the center of air distribution chamber 38 for receiving a shaft 45. Shaft 45 is rotatably mounted by a pair of sleeve bushings 46 mounted in complementary shaped holes 46*a* and 46*b* formed in air supply block 16 and manifold cap 17, respectively (FIG. 6).

An air control disc 48 is mounted on a hexagonal portion 49 of shaft 45. Disc 48 is generally complementary with air distribution chamber 38 and is freely rotatably mounted therein by shaft 45, and is formed with a pair of arcuate shaped openings 50 and 51 (FIG. 7) located diametrically opposite each other for selectively opening and closing air outlet holes 39–42. Openings 50 and 51 have arcuate lengths equal to each other and generally equal to or less than the arcuate spacing between outlet holes 39–42 of chamber 38. Disc 48 preferably is formed of nylon or similar low friction material to enable it to rotate freely within chamber 38 and eliminate sliding friction between metal components.

Figure 8:
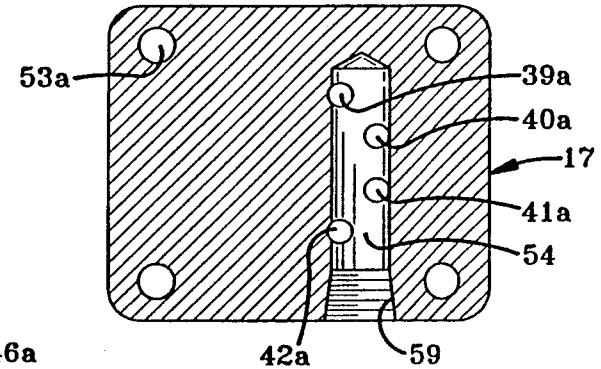
FIG. 8 is an enlarged fragmentary sectional view taken on line 8—8, FIG. 6.

Manifold cap 17 (FIGS. 6 and 8) preferably is secured by a plurality of bolts 53 which extend through holes 53*a*, to air supply block 16 and has a generally planar end face 58 which closes air distribution chamber 38. An air inlet passage 54 is formed in manifold cap 17 and is adapted to be connected to a source of high pressure fluid by a conduit 55 (FIG. 1) which is connected to a threaded portion 59 of passage 54 (FIG. 8). Air inlet passage 54 communicates with air distribution chamber 38 for supplying pressurized air into the chamber for subsequent distribution through outlet holes 39–42 by aligned air passages 39*a*, 40*a*, 41*a* and 42*a*, formed in cap 17.

A drive sprocket 56 is mounted on end 57 of shaft 45 by a key-keyway connection so as to rotate in unison with shaft 45 and air control disc 48.

Figure 3:
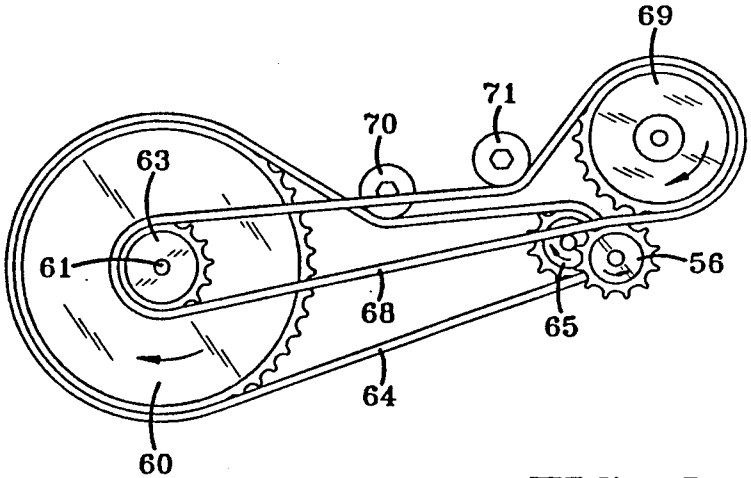
FIG. 3 is a diagrammatic side view of the timing belt and drive system for the improved cleaning system of the invention.

The particular drive system for the air cleaning system of the invention is shown generally diagrammatically in FIG. 3. This system includes a large drive sprocket 60 which is connected to an output shaft 61 of a usual gearbox attached to an electric drive motor (not shown) located within the interior of equipment 1 as described in the previously referred to patents. A small sprocket 63 also is connected to shaft 61 along with larger sprocket 60. A first trimming belt or drive chain 64 extends between large sprocket 60 and a sprocket 65 which is connected to a stripping roll 67 (FIG. 2) which is located beneath and in close proximity to tooth roll 10 for directing the removed skin carried by roll 10, in the direction of arrow B, and into a collection area.

A second drive belt or chain 68 extends between smaller drive sprocket 63 and around a larger sprocket 69 which is connected to tooth roll 10. Drive belt 68 also engages drive sprocket 56 which, as discussed above, rotates air control disc 48 within air distribution chamber 38. A pair of tensioners 70 and 71 may engage drive chains 64 and 68 respectively, to ensure proper tensions thereon.

The operation of the improved cleaning system is as follows: Pressurized air from an in-house central supply system or individual compressor is connected to conduit 55 and enters air distribution 38 through air inlet passage 54 and air passages 39*a*–42*a* of manifold cap 17, and is impressed against disc 48. As control disc 48 is rotated by drive sprocket 56 and trimming chain 68, arcuate openings 50 and 51 alternately open a respective one of the air inlet holes 39–42 to permit air to flow from inlet passage 54 through disc 48 and into the connected air inlet lines 29–32. The arcuate spacing between air outlet holes 39–42, in combination with the arcuate length of arcuate-shaped openings 50 and 51 of disc 48, is such that only one air outlet hole will be in communication with one of the arcuate shaped openings 50 and 51, with the remaining air outlet holes being closed by the solid area of disc 48. Disc 48 will be forced against the inside surface of air supply block 16 within chamber 38 by the pressure of the incoming air, thereby ensuring that nearly all of the incoming air through inlet passage 54 and connected passages 39*a*–42*a*, will pass through arcuate-shaped openings 50 and 51 and through the aligned air outlet hole 39–42.

Figure 7:
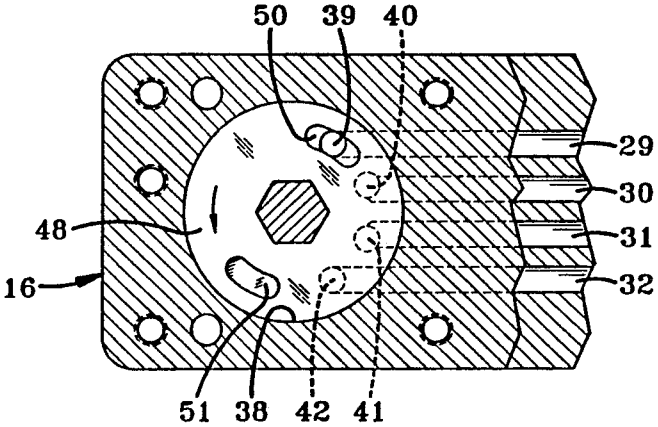
FIG. 7 is an enlarged fragmentary sectional view taken on line 7—7, FIG. 6.

For example, assuming disc 48 is in the position of FIG. 7, the incoming air will flow through disc opening 50 and through aligned outlet hole 39 and then through air inlet line 29 and then through air supply channel 23 to the four respective nozzle supply passages 19*a*–19*d* (FIG. 6) and out of the nozzles connected thereto. Thus, air is supplied only to nozzle group 19 with the three remaining nozzle groups being closed by disc 48. The air then is impinged directly upon the specific section of tooth roll 10 which is opposite of nozzle group 19 to dislodge any meat particles, fat, bone etc. which may be trapped within the teeth. As disc 48 continues to rotate, disc opening 50 will align with air outlet hole 40 permitting air to flow through fluid air line 30 and then through air supply channels 24 to nozzle group 20, with nozzle groups 19, 21 and 22 remaining closed due to the blocking of air outlet holes 39, 41 and 42 by disc 48. Thus the same volume of air is emitted through the nozzles of nozzle group 20 generally perpendicularly against another section of tooth roll 10, which section is both circumferentially and axially displaced from the previous section of the roll just cleaned by the blast of air through the nozzles of group 19 since roll 10 has continued to rotate as well as disc 48.

The speed of rotation of disc 48 and of tooth roll 10 are different so that at each revolution of roll 10 it is impinged by a different burst of air from a different nozzle group at a different location on the roll. Thereby after a predetermined number of revolutions of roll 10, the entire roll surface will be cleaned. For example, air disc 48 will be rotated at 215 r.p.m. so that a burst of air is emitted from each nozzle group 430 times per minute, due to the use of two diametrically opposite arcuate openings 50 and 51. Tooth roll 10 will be rotated at 143 r.p.m., thus being out of sequence with the bursts of air so that the same spot will not be impinged each and every time by the same burst of air, ensuring a complete coverage of the roll surface. In the preferred embodiment, an air pressure of approximately 90 psi will be supplied at manifold cap 17 with the air pressure being approximately 72 psi at the outlet nozzles, providing sufficiently strong bursts of pressurized air for efficiently cleaning any particles trapped between the teeth of roll 10.

One of the main advantages achieved by the fluid distribution system described above is that the volume of air required is only enough to supply one of fluid supply channels 23–26 and its associated nozzle group 19–22. Thus only enough air is required to fill the small supply channels and connecting lines, and need not supply large chambers or a vast number of nozzles as in prior pressurized air cleaning systems since only one group of nozzles is connected to the air supply at any one time. It can be seen from the above described sequence that an alternating series of short bursts of air is continuously being supplied against rotating roll 10, both in the longitudinal axial direction along the roll by the sequentially applying of air to first nozzle group 19 then nozzle group 20 etc., as well as circumferentially about the roll surface since the roll continues to rotate as the air is alternately supplied to each of the individual nozzle groups. Furthermore, the nozzle groups will extend at least equal to the longitudinal length of the roll to ensure that all areas of the roll are cleaned by the intermittent bursts of high pressure air impinged against the roll as it continues to rotate and strip skin from the meat being passed over roll 10.

It is readily understood that although the above description refers to the fluid as being air, other types of fluids, if desired, depending upon the particular cleaning system could be utilized. Likewise, the use of four nozzle groups, each containing four nozzles, is not critical and can be varied as to the number of groups and to the number of nozzles per group, without affecting the concept of the invention. Likewise, disc 48 may have other opening arrangements therein, other than the two arcuate-shaped openings 50 and 51 for selectively opening and closing air outlet holes 39–42.

In further accordance with the invention, it has been found that the cleaning efficiency of cleaning system 2 can be increased by using water or other liquid as a cleaning agent, in combination with the pressurized fluid or air which is impinged against the rotating roll, as described above. Prior art water cleaning systems use large quantities of water which are sprayed against rotating workpieces using the pressure of the water as the impinging force which although effective, is expensive due to the large volumes of water and the associated equipment for supplying and reclaiming the water and for pressurizing the water. Therefore, an enhancement is shown in FIGS. 9–12 wherein a relatively low pressure supply of water is permitted to mix with the supply of higher pressurized air to increase the cleaning efficiency of cleaning system 2.

A water supply block, indicated generally at 75, is secured to end face 37 of air supply block 16 by a pair of bolts 79 which are engaged in threaded holes 76 formed in end face, or by other attachment means. Water block 75 is adapted to be connected to a source of low pressurized water, as indicated by arrow C (FIG. 9), through an incoming water supply line formed by a series of elbows 77 and pipe sections 78 which communicate with a vertical water supply channel 80 formed in block 75, through a top end opening 81. A manual shut-off valve 82 may be formed in the incoming water line, if desired.

Figure 11:
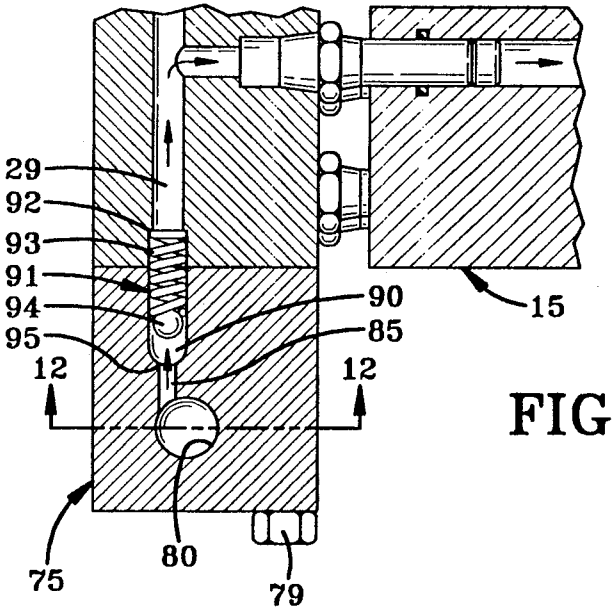
FIG. 11 is an enlarged fragmentary view of the encircled portion of FIG. 10.
Figure 12:
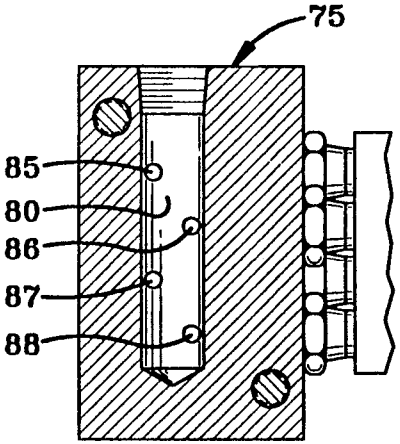
FIG. 12 is a fragmentary sectional view taken on line 12—12, FIG. 11.
Figure 10:
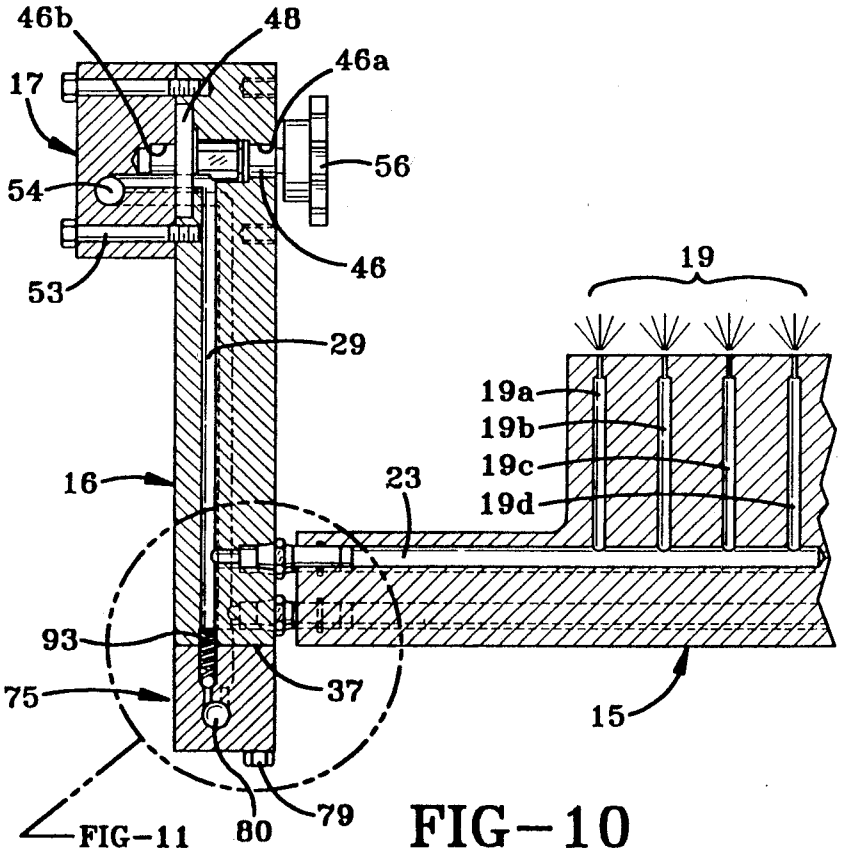
FIG. 10 is a sectional view similar to a portion of FIG. 6, showing the water supply chamber of FIG. 9 mounted on the end of the air supply block.

Prior to mounting water block 75 on end face 37 of air supply block 16, plugs 37*a* are removed from the open ends of fluid inlet lines 29–32 so that correspondingly aligned water supply ports 85, 86, 87 and 88, extend between water supply channel 80 and the open ends of air inlet lines 29, 30, 31 and 32, respectively. As best shown in FIGS. 10 and 11, water supply ports 85–88 communicate with their respective air inlet lines 29–32 through an enlarged water supply channel 90.

A one-way check valve, indicated generally at 91, is mounted in each of the water supply channels 90 and the adjacent ends of the air inlet lines, which have been slightly enlarged so as to provide an annular shoulder 92, against which is seated one end of a compression coil spring 93. Each spring 93 forces a check valve ball 94 into a closed position against an opening 95 which is formed between channel 9 and the respective water supply port.

The operation of the improved pressurized air and water mixture is best understood by reference to FIGS. 10 and 11. As discussed previously above, pressurized air is sequentially supplied through air inlet lines 29–32 to the respective nozzle groups. The pressurized air will have sufficient pressure, in combination with the biasing force exerted by spring 93, to maintain ball 94 in a closed position against water inlet opening 95. Thus, when the pressurized air is supplied to the respective air inlet line, no water can flow into that air inlet line due to valve ball 94 closing the inlet opening.

As control disc 48 rotates and sequentially shuts off the supply of pressurized air to the respective air inlet lines, the pressure of the water is sufficient to overcome the biasing force of spring 93, upon removal of the pressurized air from the respective air inlet line, so that a quantity of water will flow from supply channel 80 and into the respective aligned air inlet line around ball 94. However, immediately upon control disc 48 opening the air inlet into the respective air inlet line, the incoming air pressure will immediately shut off the flow of water and will simultaneously mix the small quantity of water which had entered the air inlet line with the pressurized air, for subsequent discharge through the respective nozzle. Thus, the incoming pressurized air, in addition to shutting off the flow of incoming water, will immediately pick up the previously injected water and impinge it against the rotating roll to increase the cleaning efficiency thereof.

In accordance with one of the advantages, the pressure of the water is not required to impinge the cleaning water against the rotating roll. The high pressure of the incoming air stream is used to achieve this result. Thus, as disc 48 continues to rotate, small quantities of water are sequentially injected into the respective aligned air inlet lines with the incoming water pressure being sufficient to overcome the biasing force of the check valve spring in the absence of the pressurized air, after which, the water supply is immediately shut off due to the air pressure, in combination with the spring pressure, forcing ball 94 into the closed position overcoming the water pressure.

Thus, only a small quantity of water at a low pressure, for example 40 psi, is required for providing water which is subsequently impinged by a high pressure, for example 100 psi, supplied entirely by the incoming high pressure air against the rotating roll. This is in contrast to prior art cleaning systems using water which relied entirely upon the pressure of the incoming relatively large supply of water itself to achieve the cleaning effect.

As best illustrated in FIG. 11, by regulating the size of check valve balls 94 with respect to the cross-sectional area of the water supply channels 90, the volume of water entering the respective air inlet lines 29–32 can be regulated. It is estimated that the present cleaning system using only approximately 4% of the water used by other types of water cleaning systems wherein the high pressure of the water is required for the cleaning of a working member instead of using the mixture of a small quantity of water with the pressure of the incoming air, as in the present invention.

A water solenoid (not shown) may be tied in with an air solenoid (not shown) in the high pressure air supply so that when the air is shut off, the incoming flow of water is also automatically shut off to prevent the discharge of water past check valve balls 94.

Accordingly, the improved cleaning system of the present invention, provides for a relatively simple arrangement of inexpensive components having a minimum number of moving parts, and in particular only a single control disc 48 which is trapped in a complementary shaped chamber 38 and driven by the same motor as that of the tooth roll being cleaned, to supply a predetermined amount of pressurized fluid, either air or another gas or fluid, individually, or in combination with a small quantity of water, to the fixed nozzles for emitting short bursts of pressurized air and/or fluid mixture against different portions of the tooth roll as it rotates past the nozzles during a meat processing operation, without interfering with the stripping process, and without the use of maintenance prone moving air seals and reciprocating components, or large quantities of water as in other known prior art cleaning systems.

Accordingly, the improved air cleaning system is simplified, provides an effective, safe, inexpensive, and efficient device which achieves all the enumerated objectives, provides for eliminating difficulties encountered with prior devices, and solves problems, and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved air cleaning system is constructed and used, the characteristics of the construction, and the advantageous, new and useful results obtained; the new and useful structures, devices, elements, arrangements, parts and combinations, are set forth in the appended claims.

I claim:

1. A cleaning system for removing particles from a rotating roll, said system including:

a manifold formed with a plurality of fixed fluid discharge nozzles extending in a generally axial direction along the roll for directing streams of a pressurized fluid against the rotating roll;

a plurality of fluid supply channels having inlet openings, each of said channels communicating with a selected group of nozzles of said manifold nozzles, for selectively supplying pressurized fluid to each of said selected nozzle groups;

fluid control means for sequentially opening and closing the fluid supply channels whereby only certain of said supply channels are open at the same time and are being supplied with fluid for subsequent discharge through their respective nozzle groups for impingement against the rotating roll, said control means including a rotating disc which sequentially opens and closes the fluid supply channels as it rotates past the fluid inlet openings of said supply channels; and drive means for rotating the roll and the disc at different speeds.

2. The cleaning system defined in claim 1 in which the disc is located within an annular fluid distribution chamber; and in which said distribution chamber communicates with the fluid supply channels.

3. The cleaning system defined in claim 2 in which the fluid inlet openings of the fluid supply channels terminate in an arcuate pattern within the annular fluid distribution chamber; and in which the control means disc is formed with a pair of arcuate slots which align with each of the inlet openings during each revolution of said disc to sequentially open and close the fluid supply openings.

4. The cleaning system defined in claim 2 in which the disc is mounted on a shaft having a drive gear attached thereto; in which the rotating roll includes a drive gear and a drive chain connected thereto; and in which a motor is operatively connected to the drive gears of the rotating roll and disc by the drive chain for simultaneously rotating said roll and disc.

5. The cleaning system defined in claim 2 in which the fluid supply channels are formed in a manifold block; in which the fluid distribution chamber is formed in a fluid supply block which is attached to the manifold block; and in which a plurality of fluid inlet lines extend through the supply block for fluidly connecting the fluid inlet openings with the fluid channels.

6. The cleaning system defined in claim 5 in which the fluid supply block is connected to the manifold block by a plurality of quick connect fluid couplers.

7. The cleaning system defined in claim 5 in which the fluid distribution chamber is closed by a manifold cap; and in which passage means is formed in the manifold cap and is adapted to be connected to a source of high pressure fluid for distribution to the nozzles.

8. The cleaning system defined in claim 1 in which the manifold is formed with four groups of nozzles, each group having four nozzles.

9. The cleaning system defined in claim 1 in which the disc is rotated at a lower speed than the rotating roll.

10. The cleaning system defined in claim 1 in which the rotating roll is mounted in a meat processing machine which includes a work supporting shelf over which a piece of meat is moved toward the rotating roll; and in which the manifold nozzles are located beneath the shelf adjacent said rotating roll.

11. The cleaning system defined in claim 1 in which the fluid nozzles direct streams of fluid generally perpendicularly against the longitudinal length of the rotating roll.

12. The cleaning system defined in claim 1 in which the rotating roll is rotated at approximately 143 r.p.m. and the disc is rotated at approximately 215 r.p.m.

13. The cleaning system defined in claim 1 in which the fluid is air.

14. The cleaning system defined in claim 1 in which a plurality of water supply lines are operatively connected to respective ones of the fluid supply lines; and in which check valve means operatively connect each of the fluid supply lines to a respective water supply line to permit a quantity of water to flow into the fluid supply lines from the water supply lines when the rotating control member sequentially closes the fluid supply lines from the source of high pressure fluid, whereby said water is subsequently discharged from the nozzle by the high pressure fluid against the rotating roll when the rotating control member opens the fluid supply lines to the source of high pressure fluid.

15. The cleaning system defined in claim 14 in which the valve means is a one-way check valve which opens and closes an opening between the fluid supply line and the water supply line; and in which the check valve includes biasing means for biasing the valve means towards a closed position.

16. An apparatus for cleaning a rotating working member including a plurality of fixed fluid discharge nozzle means extending along the rotating member for directing pressurized fluid against the working member; a plurality of air supply lines connecting each of the nozzle means to a source of high pressure air; a rotating control member cooperating with the air supply lines remote from the nozzle means, for sequentially opening and then closing certain of the air supply lines while maintaining certain others of said air supply lines closed to permit high pressure air to be sequentially supplied to only certain of the nozzle means at a given period of time for subsequent impingement against the working member; a plurality of water supply lines adapted to be connected to a source of pressurized water, each of said water supply lines being operatively connected to a respective one of the air supply lines; ,and check valve means for operatively connecting each of the air supply lines to a respective water supply line to permit a quantity of water to flow into each of the air supply lines when the rotating control member closes the air supply lines from the source of high pressure air, whereby said water is subsequently discharged from the nozzle means by the high pressure air against the rotating working member when the rotating control member opens the respective air supply lines to the source of high pressure air.

17. The apparatus defined in claim 16 in which the valve means is a ball check valve having a ball which opens and closes an opening extending between the air supply line and water supply line, and a spring for biasing the ball into a closed position.

18. The apparatus defined in claim 17 in which the pressure of the high pressure air in combination with the biasing force of the spring, is sufficient to maintain the ball in closed position and overcome the force of the pressurized water.

19. The apparatus defined in claim 17 in which the pressure of the water is greater than the biasing force of the check valve spring in order to open the check valve to permit water to flow through the check valve and into the respective air supply line when the supply of pressured air is blocked by the rotating control member from said air supply line.

20. The apparatus defined in claim 17 in which the check valve ball is located within a water flow channel extending between the check valve and the air supply line; and in which the difference between the cross sectional area of the water flow channel and the diameter of the check valve ball controls the amount of water which flows into the respective air supply line.

21. An apparatus for cleaning a rotating working member including a plurality of fixed fluid discharge nozzle means extending along the rotating member for directing pressurized fluid against said working member; a plurality of first fluid supply lines connecting each of the nozzle means to a source of a first high pressure fluid; a rotating control member cooperating with the first fluid supply lines remote from the nozzle means, for sequentially opening and then closing certain of said fluid supply lines while maintaining certain others of said fluid supply lines closed to permit said first high pressure fluid to be sequentially supplied to only certain of the nozzle means at a given period of time; a plurality of second fluid supply lines, each operatively connected to a respective one of the first fluid supply lines, and to a source of a second fluid; check valve means for operatively connecting each of the first fluid supply lines to, their respective second fluid supply lines for permitting a quantity of the second fluid to flow into the first fluid supply lines when the rotating control member closes the first fluid supply lines from the source of first high pressure fluid whereby the second fluid is subsequently discharged from the nozzle means together with the first high pressure fluid against the rotating working member when the rotating control member opens the high pressure fluid supply lines now containing the quantity of said second fluid to the source of said first high pressure fluid.

* * * * *